US005726523A

United States Patent [19]

Popov et al.

[11] Patent Number: 5,726,523

[45] Date of Patent: Mar. 10, 1998

[54] ELECTRODELESS FLUORESCENT LAMP WITH BIFILAR COIL AND FARADAY SHIELD

[75] Inventors: Oleg Popov, Needham; Jakob Maya, Brookline; Jagannathan Ravi, Bedford, all of Mass.

[73] Assignee: Matsushita Electric Works Research & Development Labratory, Woburn, Mass.

[21] Appl. No.: 643,629

[22] Filed: May 6, 1996

[51] Int. Cl.[6] ..... H01J 61/00

[52] U.S. Cl. ..... 313/161; 313/493; 313/46; 315/248; 315/344

[58] Field of Search ..... 313/141, 160, 313/493, 46, 44, 33, 20; 315/248, 344, 267, 276, 358

[56] References Cited

U.S. PATENT DOCUMENTS

| | | | |
|---|---|---|---|
| 4,710,678 | 12/1987 | Houkes et al. | 315/39 |
| 4,727,295 | 2/1988 | Postma et al. | 315/248 |
| 4,977,354 | 12/1990 | Bergervoet et al. | 313/161 |
| 5,006,752 | 4/1991 | Eggink et al. | 313/493 X |
| 5,130,912 | 7/1992 | Friederichs et al. | 313/493 X |
| 5,325,018 | 6/1994 | El-Hamamsy | 315/85 |
| 5,336,971 | 8/1994 | Vermeulen et al. | 313/493 X |
| 5,465,028 | 11/1995 | Antonis et al. | 315/248 |

FOREIGN PATENT DOCUMENTS 0 658 922 A2 6/1995 European Pat. Off. ..... H01J 65/04

*Primary Examiner*—Ashok Patel

[57] ABSTRACT

An electrodeless fluorescent lamp and fixture is disclosed which operates at radio frequencies and contains a bifilar coil to reduce RF voltage between the plasma and the coil and a metallic cylinder (10) to remove heat from a said bifilar coil. The bifilar coil consists of two windings. The primary (induction) winding (6) is used to generate RF electrical azimuthal field in the bulb volume needed to maintain the inductively-coupled RF plasma. The second (bifilar) winding (18) has essentially the same number of turns and is wound on the inductive winding (6), but in the direction opposite to that of the primary (inductive) winding. The RF current flowing in the inductive winding (6) induces an RF voltage of the opposite polarity in the bifilar winding (18), so two adjacent turns of both windings have equal (or nearly equal) but of opposite sign RF potentials with respect to the plasma. This results in the mutual "cancellation" of capacitive RF electric fields induced by both windings in the plasma and in a sheath formed between the plasma and the cavity walls. The reduction of the electric field in turn results in the lowering of a direct current voltage across the sheath thereby lowering the energy of ions which are accelerated in this sheath coating. The lowering of ion energy reduces the damage caused by ions and leads to improved maintenance and a longer life lamp.

5 Claims, 3 Drawing Sheets

ELECTRODELESS FLUORESCENT LAMP WITH BIFILAR COIL AND FARADAY SHIELD

BACKGROUND OF INVENTION

1. Field of the Invention

The present invention relates to fluorescent lamps and particularly to electrodeless, inductively-coupled fluorescent lamps (ICFL).

SUMMARY OF THE PRIOR ART

Electrodeless inductively-coupled fluorescent lamps are well known to the art and have longer life than conventional fluorescent lamps. Such lamps do not utilize a heating filament nor do they have electrodes disposed in the lamp envelope. Plasma needed for the generation of the visual radiation is produced in the ICFL by a radio frequency (RF) electric field which is inductively induced within the lamp by an induction coil located outside the envelope. In a typical electrodeless fluorescent lamp, the induction coil is disposed in a reentrant cavity of the bulbous envelope. The induction coil usually has several turns and an inductance of 1.0–4.0 μH. It is energized by a special driver which includes a matching network.

Disclosure is made in commonly-owned U.S. patent application Ser. No. 08/538,239 by Popov et al. of an inductive RF electric field in the bulb volume, $E_{ind}$, that is generated by the RF voltage which is applied across the induction coil and has a radio frequency of 13.56 MHz. One end of the coil is grounded and another end has a high RF potential of several hundred volts. This RF voltage also generates a capacitive electric field, $E_{cap}$, in the bulb volume through the parasitic capacitance between the coil turns. When $E_{cap}$ reaches a breakdown value, the self-sustained capacitive RF discharge is ignited in the volume along the cavity walls.

A substantial portion of the RF voltage which maintains the capacitive discharge drops across the sheath between the cavity walls and the plasma. This voltage is needed to provide a displacement current between the plasma and the coil turns. It also accelerates ions across the sheath from the plasma to the cavity walls. At pressures of a few hundred mTorr, typical for fluorescent lamps, the RF voltage across the sheath can be a few hundred volts. Hence, the major portion of the RF power delivered to the lamp is "spent" for the ion acceleration in the sheath but not for the plasma generation in the bulb volume.

As the RF voltage across the coil increases, the RF coil current grows together with the RF magnetic field and the RF azimuthal electric field in the bulb volume, $E_{ind}$. When $E_{ind}$ reaches a value which is high enough to maintain the inductively-coupled RF discharge, the coil RF current and the RF voltage across the coil decrease. This is accompanied with the sharp increase of the light output from the lamp. A further increase of the RF power causes an increase of the light output from the lamp but is accompanied by an increase of the RF coil current and RF voltage across the coil.

At power levels of about 50–60 W and coil inductance of ≈2 μH, the RF voltage across the coil is 400 to 500 V, while the plasma potential is close to the ground potential and to the potential of the grounded coil end. As a result, the "hot" turns of the coil have high RF potential with respect to the plasma. A substantial portion of the RF voltage between the "hot" turns and the plasma drops across the sheath which is formed between the plasma and the reentrant cavity walls.

The RF voltage also drops across the cavity walls (typically soda-lime glass) which causes a current in the glass and migration of sodium ions into the plasma.

The RF voltage across the sheath generates the direct current electric field in the sheath, $E_{dc}$, which accelerates ions to the cavity walls and damages a phosphor coating on the cavity walls such as by phosphor sputtering or mercury ion diffusion, for example.

It is known that to reduce the energy of ions bombarding the cavity walls, the RF voltage in the sheath should be reduced. This can be achieved by a decrease of the RF voltage across the coil (maintaining voltage, $V_m$) or by the reduction of capacitive coupling between the coil and the plasma. The prior art has utilized various schemes of Faraday shielding between the coil and the plasma such as found in U.S. Pat. No. 4,727,295 by Postma et al., U.S. Pat. No. 5,325,018 by El-Hamamsy, and U.S. patent application Ser. No. 08/538,239 by Popov et al.

In another approach, U.S. Pat. No. 4,710,678 by Houkes et al., U.S. Pat. No. 5,465,028 by Antonis et al., and EP 0 658 922 A2 by Daniels et al. disclose the use of a bifilar coil to improve the lamp ignition. The electric field generated by the bifilar winding in the plasma adds to the electric field generated in the plasma by the induction winding to suppress the interference current generated by the RF voltage across the induction coil. However, these patents neither addressed the issue of capacitive coupling between the coil and plasma nor did they disclose the need of the reduction of RF voltage in the sheath between the plasma and cavity walls. Moreover, there is no disclosure that the bifilar (second) winding must be wound in the direction opposite to that of the induction (first) winding.

The other problems to be handled in the electrodeless fluorescent lamp operated at power P>20 W is coil and cavity thermal management. To keep a coil operable, its temperature should be below about 250° C. To provide this requirement, the U.S. patent application Ser. No. 08/538,239 by Popov et al. discloses the implementation of a special means for heat removal from the coil area. A thin wall metal cylinder (≈1 mm thick) made from a high thermoconductive material (e.g. Al) was disposed between the coil and the reentrant cavity. To remove the plasma/coil heat further, the cylinder was welded to a lamp base which was also welded to a heat sink. The aluminum cylinder was grounded and worked as the Faraday shield and had several slits and cuts in order to reduce eddy currents in the cylinder and, hence, reduce RF power losses in the Faraday shield. The Faraday shield, however, decreases drastically the capacitive coupling between the coil and the lamp volume that in turn causes a substantial increase of the starting voltage.

SUMMARY OF THE INVENTION

An object of the present invention is to provide a light source which can be substituted for an incandescent light source, a high pressure mercury light source, a metal halide light source or a compact fluorescent light source.

Another object of the present invention is to provide an electrodeless long-life light source with an induction coil which can ignite an RF discharge in the lamp bulb at reasonably low RF voltage of few hundred volts.

A further object of the invention is to design a new coil which has a low RF potential with respect to the plasma potential so as to reduce the energy of ions incoming to the reentrant cavity walls and to diminish the phosphor coating degradation.

Still another object of the present invention is to design a coil which has capacitive coupling to the grounded plasma so the minimum RF coil voltage needed for the ignition of the capacitive RF discharge is not higher than the minimum coil RF voltage needed for the transition from the capacitive RF discharge to the inductively-coupled RF discharge and for maintaining the inductive discharge at required RF power.

Another object of the present invention is to remove the heat from the coil and the cavity in a manner so as to reduce the coil temperature to about 200° C. or lower.

A further object of the present invention is to design a simple structure which simultaneously solves the thermal coil/cavity problem and considerably reduces the RF capacitive voltage between the coil and the plasma.

In particular, the invention involves an electrodeless radio-frequency fluorescent lamp disposed in a fixture. The lamp includes a bulbous envelope filled with a rare gas and a vaporizable metal fill. A reentrant cavity is disposed in the envelope. A phosphor coating is disposed on the interior of the envelope for the generation of visible light. A lamp base is disposed outside the envelope and the fixture is attached to the lamp base. An induction coil and RF excitation means is associated with the coil for the generation of a plasma to produce visible radiation and UV radiation to excite the phosphor coating. The coil and the means are situated outside said envelope and fitted within the cavity. A second winding is disposed in the cavity and wound together, but in an opposite direction, with the induction winding to form a bifilar coil whereby to substantially reduce RF voltage between the coil and the plasma thereby to reduce energy of ions bombarding said phosphor coating on the inner surface of the cavity walls thereby improving the light depreciation rate and contributing to a long-life lamp. The first and the second winding are insulated from each other preferably by a coating of Teflon disposed on each of the windings. Preferably, the primary winding has a diameter of 2 to 4 times the diameter of the secondary winding. A heat sink comprising a metallic cylinder is fitted around the bifilar coil. The cylinder is formed of a metal with high thermal conductivity and is disposed in the cavity to remove heat generated by the plasma from the cavity and the coil. The heat sink suppresses capacitive coupling between the coil and the plasma whereby to reduce ion bombardment of the phosphor coating on the inner surface of the cavity thereby improving the lamp life. A support frame and a conventional matching network is disposed in the fixture. The matching network has electrical connections with the induction winding and the bifilar winding and the radio-frequency driver located outside of the fixture.

DESCRIPTION OF THE PREFERRED EMBODIMENTS

Figure 1:
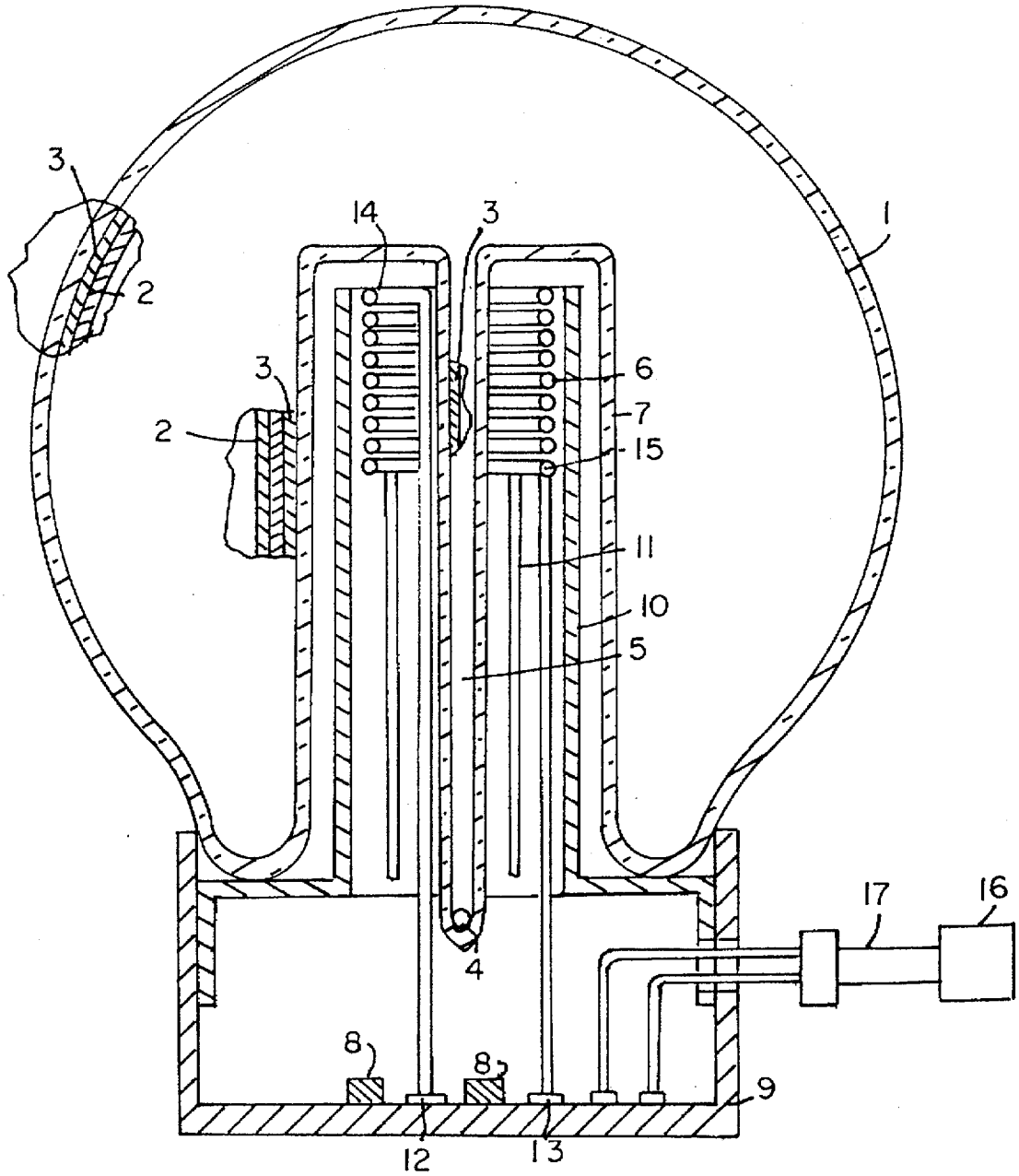
FIG. 1 (PRIOR ART)
FIG. 1 is a cross-sectional view of the prior art lamp of Popov et al., U.S. patent application Ser. No. 08/538,239.

Before describing preferred embodiments, reference is made in FIG. 1 to a lamp of the prior art, U.S. patent application Ser. No. 08/538,239 by Popov et al. to illustrate the general construction of the lamp and the placement of the various layers and coatings utilized with the lamp of the present invention. A bulbous envelope 1 is coated with the phosphor 2 and the protective coating 3 and contains a volume filled with the mixture of rare gas (krypton or argon at 0.1–10 Torr) and vaporizable metal vapor (mercury or cadmium). The metal vapor pressure is controlled by the temperature of the amalgam which is positioned in the cold spot. In prior art the amalgam 4 was positioned at the end of the tubulation 5 which is also used for the bulb exhaustion.

The induction coil 6 is set in the reentrant cavity 7 and is powered from the conventional matching network 8 located at the bottom of the lamp base 9. The top turn 14 of the coil 6 has a lead 12 which is connected to the RF output of the matching network 8 while the bottom turn 15 has a lead 13 which is grounded. The matching network 8 is connected to the driver 16 by means of the RF cable 17. A thin wall (1–1.5 mm thick) cylinder is made from metal having high thermal and electrical conductivity, for example: aluminum, surrounds the induction coil 6. The cylinder 10 is grounded and works as the Faraday shield and as the heat removal. To reduce eddy currents several cuts and slits 11 were made along the cavity axis. The cylinder is welded to the lamp base 9 which incorporates the induction coil leads 12 and 13 and the matching network 8.

To increase capacitive coupling between the coil and the plasma and, hence, to reduce lamp starting voltage, a high RF potential turn 14 of the induction coil 6 was at the same plane as the top edge of the Faraday shield 10, or 1 mm above the edge.

Since the turn 14 was not electrostatically shielded by the metal cylinder 10 it had a capacitive coupling with the plasma through the cavity glass walls that causes the formation of the RF voltage across the sheath between the plasma and the cavity walls.

To substantially reduce RF voltage between the coil and the grounded plasma, we use two approaches. Each approach utilizes a second ("bifilar") winding on the turns of the induction winding in a manner such that the resulting potential of each two neighboring turns of both windings with the respect to the grounded plasma is close to zero.

Figure 2:
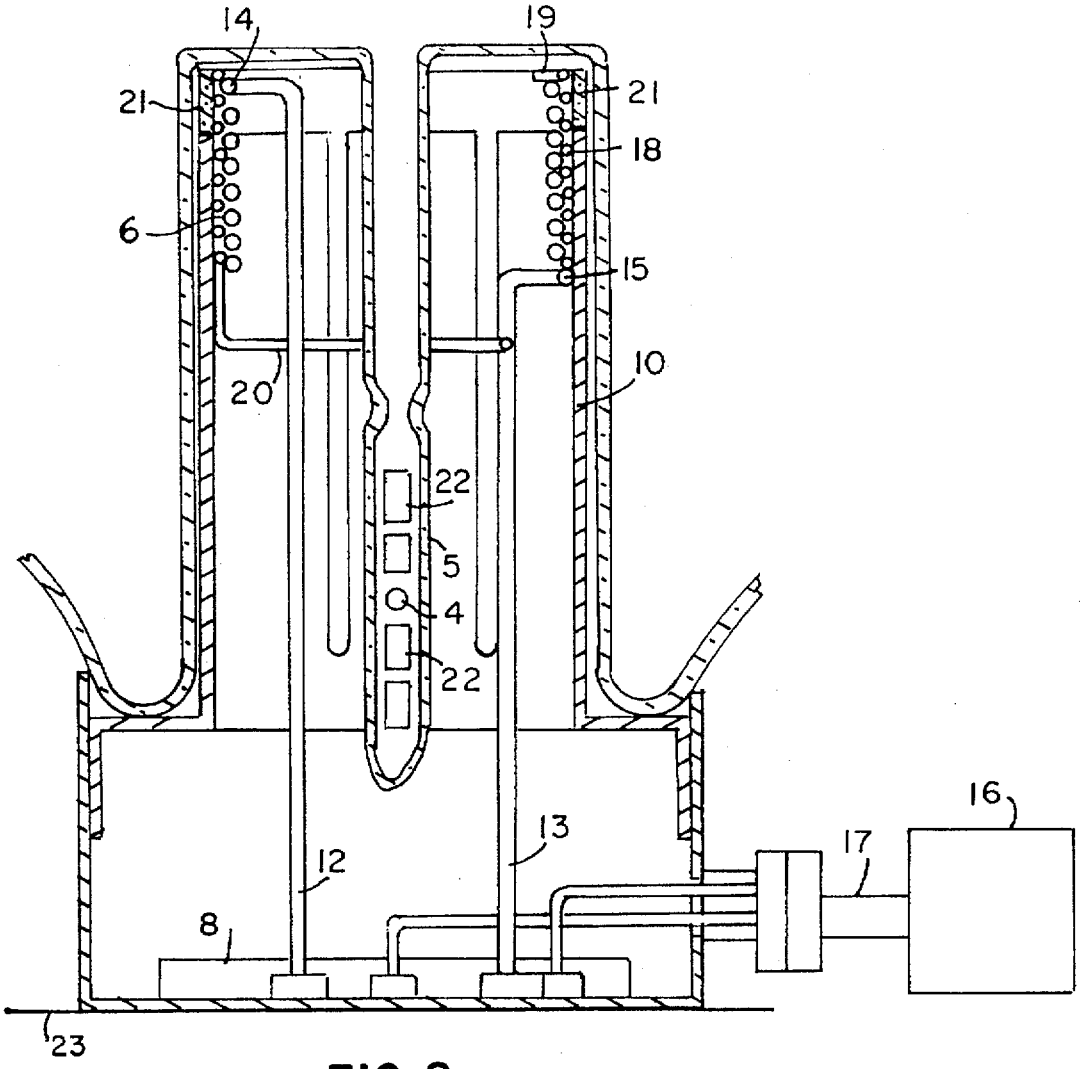
FIG. 2 is a cross-sectional view of the reentrant cavity and construction of one embodiment of the present invention which illustrates a bifilar coil inside of the Faraday cylinder.

The schematic of the first embodiment of the present invention is shown in FIG. 2. The RF voltage at a frequency of few MHz is applied from a driver 16 by means of a RF cable 17 to a matching network 8. The matching network consists of series of capacitances which are connected in parallel and in series with the induction winding 6 by means of leads 12 and 13. The RF lead 12 is connected to the top turns 14 of the induction winding 6 while the grounded lead 13 is connected to the bottom turn of the winding 6.

The induction winding 6 is inserted inside of the metal (A1) cylinder 10 which is grounded and works as a Faraday shield and to remove the heat. A second ("bifilar") winding 18 is wound on the turns of the induction winding 6 in the direction opposite to that of the induction winding. Each of the induction winding 6 and the bifilar winding 18 has a coating or wrapping of Teflon (not shown) whereby to insulate them from each other. The wire itself is preferably formed of copper with a coating of silver. The diameter of the induction winding 6 is preferably between 2 to 4 greater than the bifilar winding 18. To wrap the bifilar winding 18 in a direction opposite to the induction winding 6 we begin by wrapping one turn of the bifilar winding 18 snugly within the space between two abutting turns of the induction winding 6. At a point in each turn of the induction winding 6, the bifilar winding is moved over the turn of the induction winding (from between the space mentioned above) and placed into the next adjacent space between abutting turns of the induction winding.

The first end 19 of the bifilar winding 18 is dangling ("floating") and has the high RF potential with respect to ground (plasma). The second end 20 of the bifilar winding 18 is grounded. Each turn of the bifilar winding 18 has RF potential equal (or substantially equal) to the RF potential of the adjacent turn of the induction winding 6 but has the opposite sign. Thus, the resulting coil RF potential with respect to the ground and, hence, to the plasma is zero (or close to zero).

The low RF potential between the coil and the plasma causes the starting problem for the coil inserted completely inside the Faraday cylinder. To reduce the shielding effect of the Faraday cylinder the bifilar coil extends 4–5 mm above the cylinder that improves the capacitive coupling between the coil and the plasma. A dielectric spacer 21 (Teflon or alumina) protects the extending turns from the direct radiation from the plasma.

The amalgam 4 is located in the tubulation 5 and controls the mercury, pressure in the bulb. Several glass pieces 22 determine the exact position of the amalgam 4.

Figure 3:
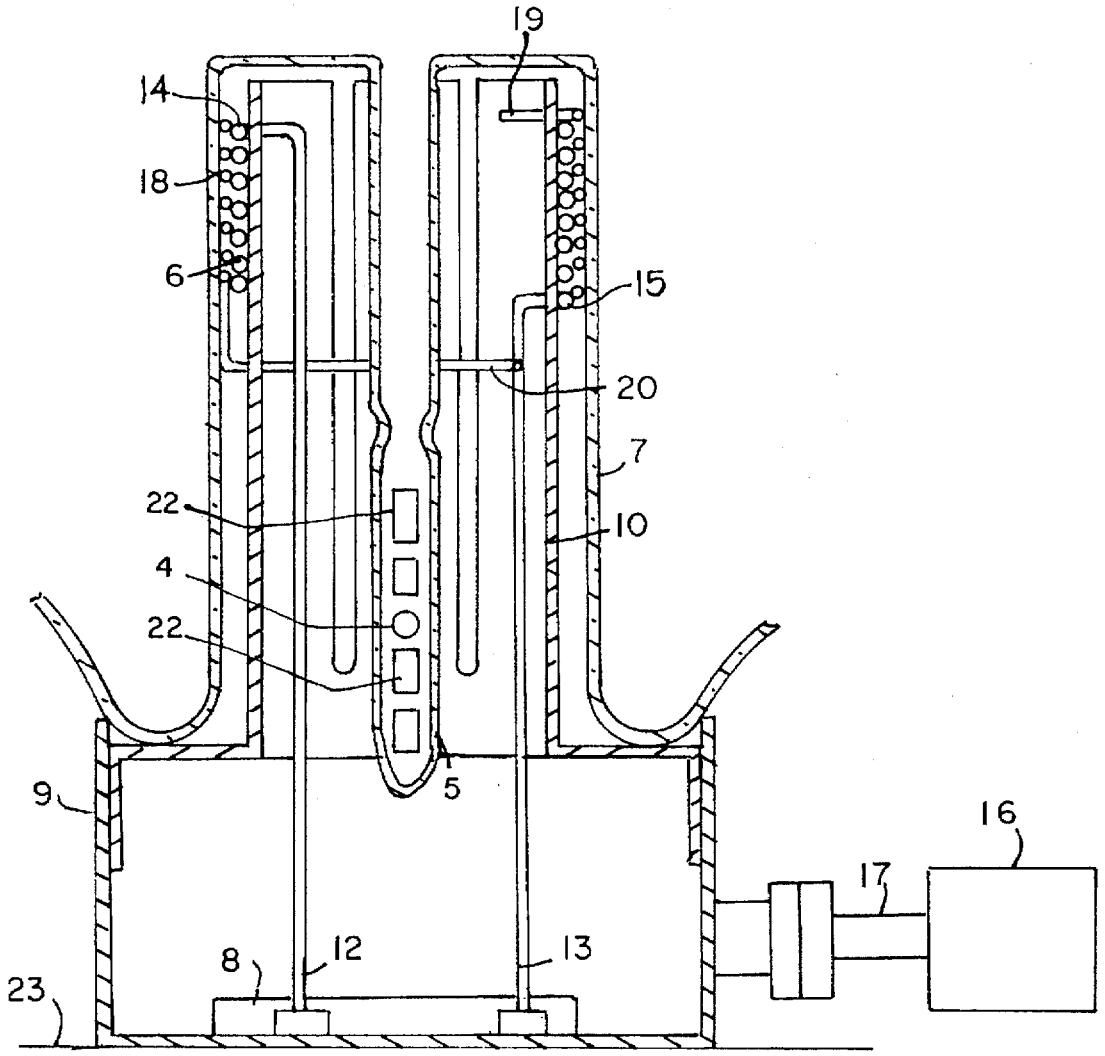
FIG. 3 is a cross-sectional view of the reentrant cavity and construction of another embodiment of the present invention which illustrates a bifilar coil outside of the Faraday cylinder.

The second embodiment of the present invention is shown in FIG. 3. The bifilar coil is located outside the metal cylinder 10, i.e., between the walls of the cylinder 10 and the cavity 7. The coil again includes two windings, the induction winding 6 and the bifilar winding 18. The top turn 14 of the induction winding 6 has a lead 12 which is connected to the high RF voltage end of the matching network 8. The bottom turn 15 of the induction winding 6 has a lead 13 which is grounded. The bifilar winding 18 have a dangling "high voltage" end 19 and the grounded end 20. The bifilar winding 18 is wound in the direction opposite to that of the induction winding 6, so the resulting RF potential of each neighboring turn of the two windings with respect to the grounded plasma is close to zero.

In the second embodiment, the grounded metal cylinder 10 does not effect capacitive coupling between the coil and the plasma, i.e., it does not operate as Faraday shield between coil and the plasma in the bulb. But Faraday shield 10 reduces the capacitive coupling between the coil and the plasma in the tubulation 5. This is important because the ions from the plasma sustained in the tubulation 5 bombard the tubulation walls, remove the protective coating and are deposited on the tubulation walls which become a "sink" for mercury atoms.

Also, the metal cylinder 10 efficiently removes heat from the plasma and directs the heat to the base 9 and then to the heat sink 23, so the coil temperature doe snot exceed 200° C. even at the ambient temperature of 70° C.

We performed a series of experiments with single and bifilar coils having inductances of 1.5–2.5 μH. The RF voltages across the induction and the bifilar windings of the bifilar coil were measured with respect to the ground with and without RF plasma. At the same RF power, the measured RF voltages had values close to each other but of the opposite sign, as it is shown in Table 1.

TABLE 1

BIFILAR COIL RF VOLTAGES ACROSS THE INDUCTION AND BIFILAR WINDINGS $L_c$ = 1.7 μH

| | | | | | |
|---|---|---|---|---|---|
| $V_{ind}$, V | 140 | 200 | 277 | 788 | 1100 |
| $V_{blfr}$, V | −122 | −174 | −242 | −669 | −952 |

It is seen that RF voltages across both windings differ from each other by about 15–20%. So, the resulting RF voltage across the coil "seen" by the grounded plasma as $V_{ind}+V_{blfr}$ drops substantially. Since the typical RF voltage across the coil of the inductance of 2.0 μH is 350–450 V, the actual RF voltage between the coil and the plasma is 80–85% smaller, i.e., 50–90 V. As a result, the RF voltage across the sheath between the plasma and the cavity walls also is small. Subsequently, the direct current voltage, $V_{dc}$, in the sheath is also small and ions which are accelerated in the sheath from the plasma to the cavity walls have low energy and produce less damage to the cavity wall coatings.

The use of the bifilar coil effects the RF voltage across the coil needed for the ignition of the capacitive RF discharge, $V_{cap}$. We measured $V_{cap}$ in lamps employing three types of coils: single, bifilar inside the Faraday shield (embodiment 1), and bifilar outside the Faraday shield (embodiment 2). The results of these measurements at room ambient temperature are shown in Table 2.

TABLE 2

CAPACITIVE DISCHARGE IGNITION VOLTAGES IN ICF LAMPS USING SINGLE AND BIFILAR COILS $L_{single} = L_{bflr}$ = 1.7 μH Ar; 0.3 Torr; $T_{amb}$ = 25°C.

| Lamp # | SINGLE $V_{o-p}$, V | BFLR INSIDE $V_{o-p}$, V | BFLR OUTSIDE $V_{o-p}$, V |
|---|---|---|---|
| 1 | 410 | 416 | 313 |
| 2 | 370 | 416 | 325 |
| 3 | 313 | 353 | 296 |
| 4 | 308 | 365 | 251 |

It is seen from Table 2 that the coil voltage needed to ignite the capacitive discharge in the lamp employing a bifilar coil inside the Faraday shield is higher than that in the lamp using the single coil inserted in the Faraday shield. This result was expected because the introduction of the second winding with the RF voltage of the opposite polarity reduces the actual RF voltage between the coil and space in the bulb volume along the cavity walls. The decrease of the RF voltage results in the decrease of the capacitive RF electric field in said space. Therefore, to increase the capacitive RF electric field to the value needed for the capacitive discharge ignition, $E_{cap}$, one has to increase the RF voltage across the coil.

In the case, when the bifilar coil is positioned outside the Faraday shield, the space in the bulb volume along the cavity walls is not electrostatically shielded from the coil. Therefore, a relatively low RF voltage across the coil, $V_c$, (even lower than in the single coil case) is needed to induce in this space the capacitive discharge ignition RF electric field, $E_{cap}$.

The voltage across the coil which is needed for the transition of the capacitive discharge to the inductive one, $V_{tr}$, was measured in several ICF lamps employing a single coil, and a bifilar coil outside of the shield. The results of these measurements at low ambient temperature of −20° C. are given in Table 3.

TABLE 3

TRANSITION VOLTAGES IN ICF LAMPS EMPLOYING SINGLE AND BIFILAR COILS $L_{single} = L_{bflr} = 1.7$ μH
Ar; 0.3 Torr; $T_{amb} = -20°$ C.

| Lamp # | $V_{single}$ $V_{o-p}$ | $V_{bflr}$ $V_{o-p}$ |
|---|---|---|
| 1 | 509 | 484 |
| 2 | 589 | 484 |
| 3 | 634 | 603 |
| 4 | 482 | 468 |

It can be seen from Table 3 that the transition voltage in lamps employing a bifilar coil outside the Faraday shield is smaller than that in lamps employing a single coil. This is because the bifilar coil has a larger diameter, $D_{coil}$, than the single coil due to the finite thickness of the Faraday shield (1–1.5 mm) (see FIGS. 1 and 3). So the ratio $D_{coil}/D_{pl}$ is larger in the bifilar case. ($D_{pl}$ is the plasma diameter.) The larger ratio $D_{coil}/D_{pl}$ results in better coupling between the bifilar coil and the plasma that in turn leads to smaller RF power losses in the coil and, hence, in lower RF voltages needed for the transition from the capacitive discharge to the inductive one. For the same reason the maintaining voltage in lamps employing a bifilar coil outside the Faraday shield is smaller than that in lamps employing a single coil which diameter is smaller than the diameter of the bifilar coil.

While it is apparent that changes and modifications can be made within the spirit and scope of the present invention, it is our intention, however, only to be limited by the appended claims.

As our invention we claim:

1. An electrodeless RF fluorescent lamp system comprising:

a bulbous lamp envelope and a reentrant cavity disposed in said envelope, a rare gas and vaporizable metal fill in said envelope, a phosphor coating on the interior thereof for generation of visible light a reflective coating on the cavity inner walls and a protective coating on said inner walls of said envelope and said cavity, a lamp base and a fixture disposed outside said envelope;

a bifilar coil disposed outside said envelope and disposed within said cavity, said bifilar coil having its windings oriented in opposite directions;

a metal cylinder having high thermal and electrical conductivity in said cavity to remove heat from said cavity and for the reduction of capacitive coupling between said coil and said plasma and reduce ion bombardment of said phosphor coating thereby to contribute to lamp life, said cylinder having an array of openings to reduce eddy current in said cylinder.

2. The lamp system according to claim 1 wherein said cylinder and said lamp base are grounded so to provide the grounding of the plasma.

3. The lamp system according to claim 1 wherein an induction winding of said bifilar coil has two ends where its top end is connected to a RF hot line and its bottom end is connected to a ground, said bifilar coil having two windings wound in the opposite directions, one of said windings being an induction winding and another is a bifilar winding having the top end-dangling and the bottom end grounded so each pair of neighboring turns of said windings have equal but opposite polarity RF potential with respect to the grounded plasma, said bifilar coil being disposed inside said cylinder, and the top end of said coil extending 4–6 mm above the top end of said cylinder.

4. The lamp system according to claim 1 wherein said bifilar coil is disposed outside said cylinder, the top end of said bifilar winding dangling and the bottom end being grounded whereby the resulting potential of two neighboring turns of an induction and bifilar winding is close to zero with respect to the grounded plasma.

5. The lamp system according to claim 2 wherein said metal cylinder is grounded to reduce capacitive coupling between said coil and plasma in the tubulation whereby to reduce the intensity of the RF capacitive discharge in the tubulation and reduce the ion density and energy bombarding the tubulation walls thereby reducing the consumption of mercury ions by the tubulation walls whereby to improve lamp stability and extend lamp life.

* * * * *